US011464388B2

(12) United States Patent
Kim et al.

(10) Patent No.: US 11,464,388 B2
(45) Date of Patent: Oct. 11, 2022

(54) HOUSEHOLD DISHWASHER

(71) Applicant: PRIME.CO., LTD., Incheon (KR)

(72) Inventors: Sung Hyun Kim, Incheon (KR); Sung Woo Kim, Seoul (KR)

(73) Assignee: PRIME.CO., LTD, Incheon (KR)

( * ) Notice: Subject to any disclaimer, the term of this patent is extended or adjusted under 35 U.S.C. 154(b) by 17 days.

(21) Appl. No.: 17/062,626

(22) Filed: Oct. 4, 2020

(65) Prior Publication Data

US 2022/0079411 A1 Mar. 17, 2022

(30) Foreign Application Priority Data

Sep. 16, 2020 (KR) ..... 10-2020-0119411

(51) Int. Cl.
*A47L 15/46* (2006.01)
*A47L 15/00* (2006.01)
(Continued)

(52) U.S. Cl.
CPC ..... *A47L 15/0036* (2013.01); *A47L 15/0023* (2013.01); *A47L 15/13* (2013.01); *A47L 15/4234* (2013.01); *A47L 15/4242* (2013.01); *A47L 15/4278* (2013.01); *A47L 15/4285* (2013.01); *A47L 2501/01* (2013.01); *A47L 2501/06* (2013.01); *A47L 2501/14* (2013.01); *A47L 2501/16* (2013.01); *A47L 2501/20* (2013.01); *A47L 2501/30* (2013.01)

(58) Field of Classification Search
None
See application file for complete search history.

(56) References Cited

U.S. PATENT DOCUMENTS 5,031,650 A * 7/1991 Nagata ..... A47L 15/4202 134/111
2009/0071514 A1* 3/2009 Roth ..... A47L 15/485 134/56 D (Continued)

FOREIGN PATENT DOCUMENTS

JP 04-325135 * 11/1992
KR 10-2006-0010363 A 2/2006

OTHER PUBLICATIONS

Machine Translation of JP04-325135 by Hagiwara, published Nov. 13, 1992.*

*Primary Examiner* — Mikhail Kornakov
*Assistant Examiner* — Ryan L Coleman

(57) ABSTRACT

A household dishwasher includes: a washing water spray nozzle module disposed on an area of inner surfaces of a washing chamber and spraying washing water, which is supplied from a water supply tube, into the washing chamber; a steam generation module disposed in the washing chamber and supplying steam into the washing chamber using the washing water supplied from the washing water spray nozzle module; an induction module disposed on an outer surface of the washing chamber and heating the washing water supplied in the washing chamber; an ultrasonic vibration module disposed on an outer surface of the washing chamber and applying ultrasonic vibration to the washing water in the washing chamber to perform ultrasonic washing; and a controller disposed in a body and controlling operational relationships of internal components in response to washing order signals from a user.

7 Claims, 5 Drawing Sheets

(51) Int. Cl.
*A47L 15/42* (2006.01)
*A47L 15/13* (2006.01)

(56) References Cited

U.S. PATENT DOCUMENTS

2009/0301530 A1* 12/2009 Shin ..... A47L 15/4242
134/58 D
2010/0154830 A1* 6/2010 Lau ..... A47L 15/0015
134/25.2
2014/0360530 A1* 12/2014 Pers ..... A47L 15/0049
134/18
2018/0228341 A1* 8/2018 Stojalowski ..... A61L 2/18

* cited by examiner

[FIG. 1]
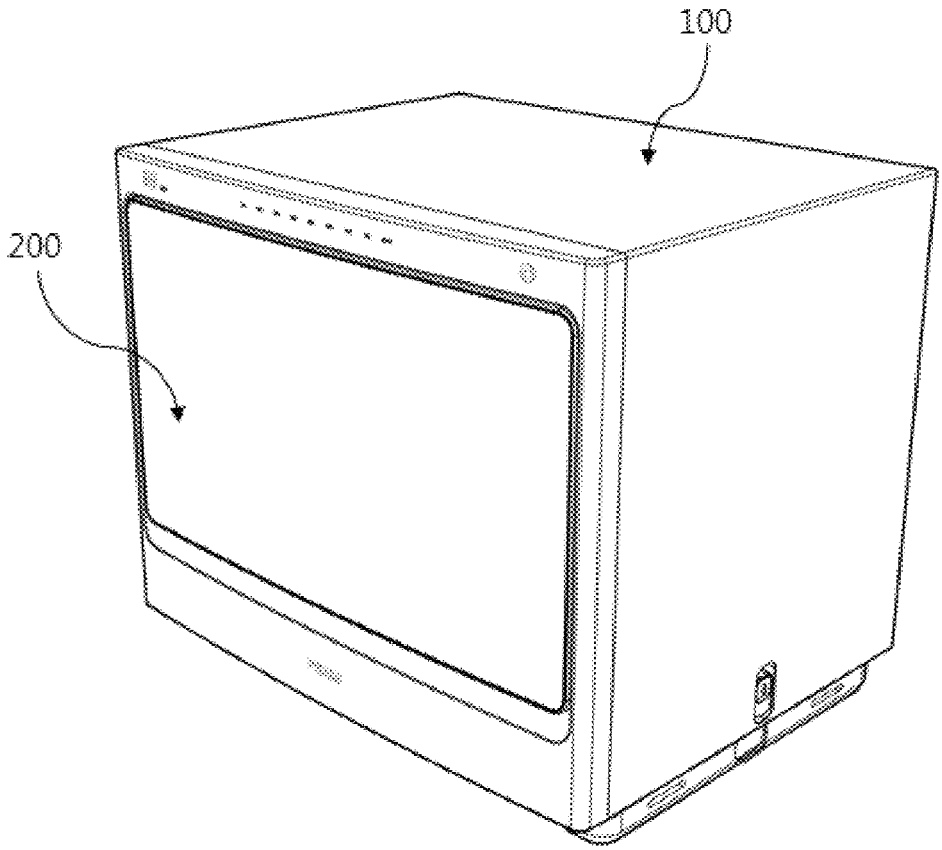

[FIG. 2]
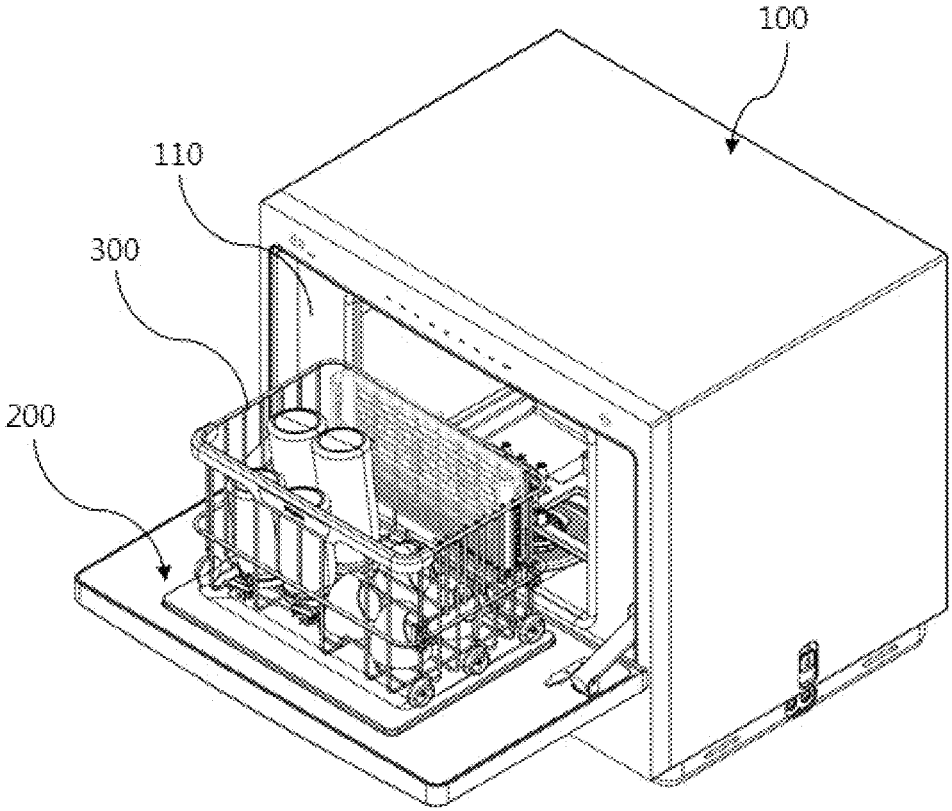

[FIG. 3]
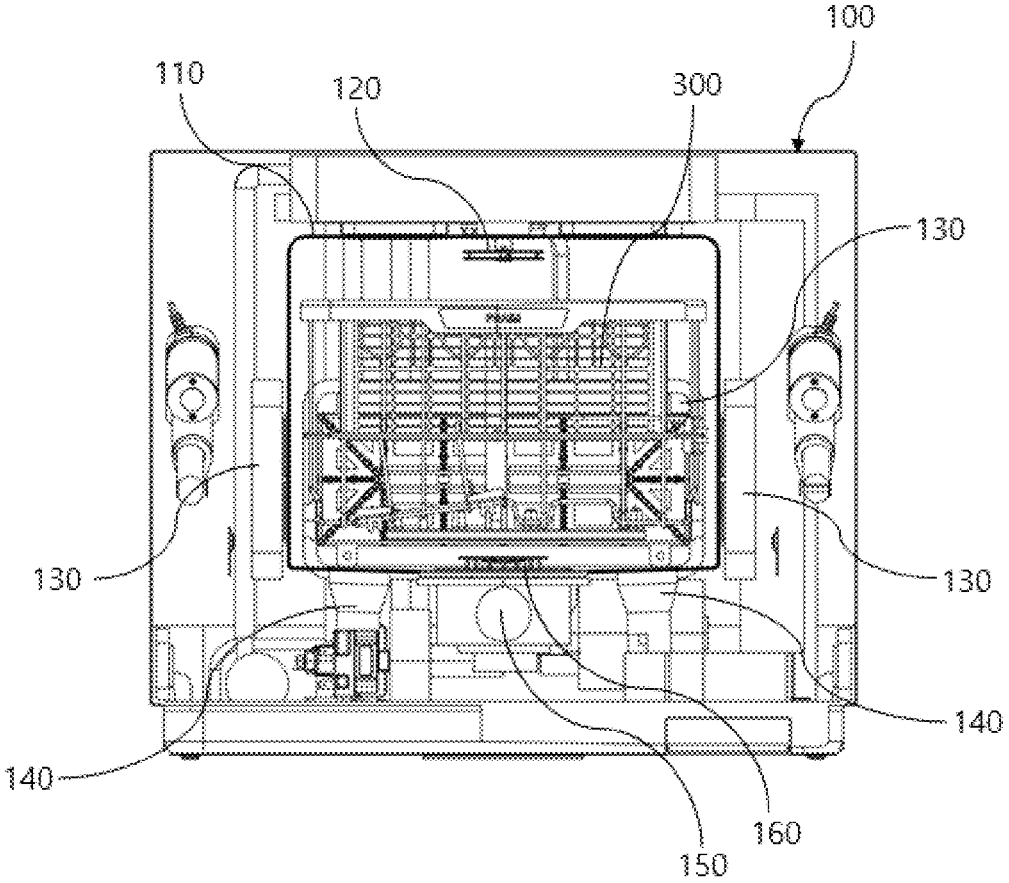

[FIG. 4]
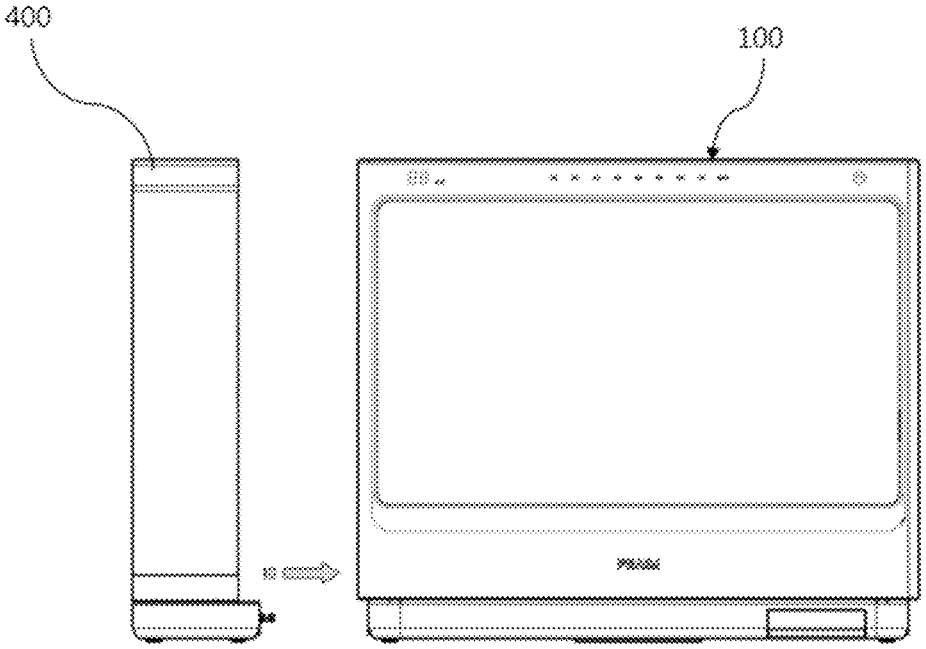

[FIG. 5]
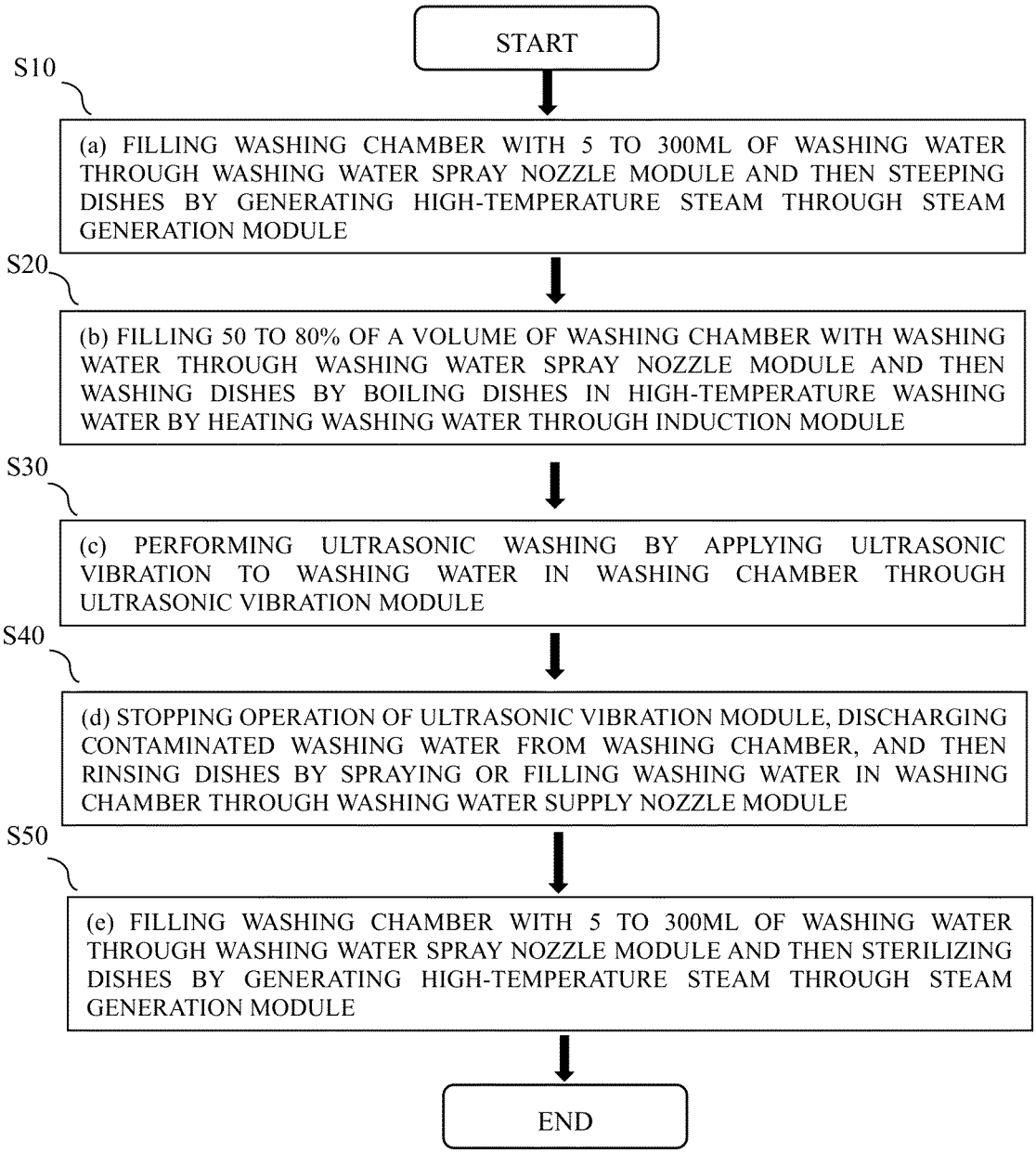

HOUSEHOLD DISHWASHER

CROSS REFERENCE TO RELATED APPLICATION

The present application claims priority under 35 U.S.C. 119(a) to Korean Patent Application No. 10-2020-0119411, filed Sep. 16, 2020, the entire contents of which is incorporated herein for all purposes by this reference.

BACKGROUND OF THE INVENTION

Field of the Invention

The present disclosure relates to a household dishwasher having improved performance.

Description of the Related Art

In general, a household dishwasher is a home appliance that removes residues of food on the surface of dishes using high-pressure washing water that is sprayed from spraying nozzles. Household dishwashers that have a more spatial restriction, unlike commercial use medium-size and large-size dishwashers, and are specified to wash a small number of dishes, so they are manufactured in compact structures. Further, the demand for household dishwashers is at present increasing due to convenience.

At present, household dishwashers that are usually on the market are usually composed of a tub having a washing chamber and a sump mounted on the bottom of the tub and keeping washing water. The washing water is pumped up to spray nozzles by a washing pump disposed in the sump, the washing water moved to the spray nozzle is sprayed at high pressure through spray holes formed at the ends of the spray nozzle, and the washing water sprayed at high pressure hits against the surfaces of dishes, whereby debris such as residues of food on the dishes are dropped to the floor of the tub.

However, according to the household dishwasher using the spray type that sprays high-pressure washing water through washing water spray nozzles in the related art, there are dead zones that the high-pressure washing water cannot reach between the dishes in the rack, so the dishes in the washing chamber are not entirely uniformly washed and some parts are not completely washed in some cases, whereby there is a problem of requiring additional washing. Further, there is inconvenience that a user has to set dishes one by one at the angle advantageous for washing when putting the dishes in the rack to reduce the dead zones of the dishes that the high-pressure washing water cannot reach.

SUMMARY

The present disclosure has been made in an effort to solve the problems and an objective of the present invention is to provide a household dishwasher that can entirely and uniformly wash dishes without a washing dead zone of in comparison to the household dishwasher using the spray type that sprays high-pressure washing water, and that does not require a user to carefully set up dishes one by one at the angle advantageous for washing when putting the dishes in the rack.

The objectives to implement in the disclosure are not limited to the technical problems described above and other objectives that are not stated herein will be clearly understood by those skilled in the art from the following specifications.

In order to achieve the objectives, the present disclosure relates to a household dishwasher, and in more detail, relates to a household dishwasher that includes: a body having a washing chamber therein; a door disposed on the body and opening and closing an opening of the washing chamber. The household dishwasher includes: a washing water spray nozzle module disposed on an area of inner surfaces of the washing chamber and spraying washing water, which is supplied from a water supply tube, into the washing chamber; a steam generation module disposed in the washing chamber and supplying steam into the washing chamber using the washing water supplied from the washing water spray nozzle module; an induction module disposed on an outer surface of the washing chamber and heating the washing water supplied in the washing chamber; an ultrasonic vibration module disposed on an outer surface of the washing chamber and applying ultrasonic vibration to the washing water in the washing chamber to perform ultrasonic washing; and a controller disposed in the body and controlling operational relationships of internal components in response to washing order signals from a user.

According to the household dishwasher of the present disclosure, it is possible to improve washing performance because it is possible to uniformly wash all dishes without a washing dead zone, as compared with the existing household dishwasher using the spray type that sprays high-pressure washing water, so it is possible to improve washing performance. Further, there is no need for carefully setting up dishes one by one at the angle advantageous for washing when putting the dishes into a rack, so there is an effect of being able to improve convenience in use.

BRIEF DESCRIPTION OF THE DRAWINGS

The above and other objectives, features and other advantages of the present invention will be more clearly understood from the following detailed description when taken in conjunction with the accompanying drawings, in which:

FIG. 1 is a perspective view of a household dishwasher according to an embodiment of the present disclosure;

FIG. 2 is a perspective view of the household dishwasher according to an embodiment of the present disclosure with a door open;

FIG. 3 is a cross-sectional view showing the internal structure of the household dishwasher according to an embodiment of the present disclosure;

FIG. 4 is a view showing an example of a water tank that can be detachably attached to a main body of the household dishwasher according to an embodiment of the present disclosure;

FIG. 5 is a diagram showing a washing process that is controlled by a controller of the household dishwasher according to an embodiment of the present disclosure.

DETAILED DESCRIPTION OF THE INVENTION

The present disclosure may be modified in various ways and implemented by various exemplary embodiments, so that specific exemplary embodiments are shown in the drawings and will be described in detail herein. However, it is to be understood that the present disclosure is not limited to the specific exemplary embodiments, but includes all modifications, equivalents, and substitutions included in the spirit and the scope of the present disclosure. In description of the present disclosure, detailed descriptions of well-known technologies will be omitted not to obscure the description of the present disclosure with unnecessary details.

Terms used in the present specification are used only to describe specific exemplary embodiments rather than limiting the present disclosure. Singular forms are intended to include plural forms unless the context clearly indicates otherwise. It will be further understood that the terms "comprise", "include", or "have" used in this specification, specify the presence of stated features, steps, operations, components, parts, or a combination thereof, but do not preclude the presence or addition of one or more other features, numerals, steps, operations, components, parts, or a combination thereof.

Terms used in the specification, 'first', 'second', 'a', 'b', etc., may be used to describe various components, but the components are not to be construed as being limited to the terms. The terms are used only to distinguish one component from another component.

The present disclosure relates to a household dishwasher, and in more detail, relates to a household dishwasher that includes: a body having a washing chamber therein; and a door disposed on the body and opening and closing an opening of the washing chamber. The household dishwasher includes: a washing water spray nozzle module disposed on an area of inner surfaces of the washing chamber and spraying washing water, which is supplied from a water supply tube, into the washing chamber; a steam generation module disposed in the washing chamber and supplying steam into the washing chamber using the washing water supplied from the washing water spray nozzle module; an induction module disposed on an outer surface of the washing chamber and heating the washing water supplied in the washing chamber; an ultrasonic vibration module disposed on an outer surface of the washing chamber and applying ultrasonic vibration to the washing water in the washing chamber to perform ultrasonic washing; and a controller disposed in the body and controlling operational relationships of internal components in response to washing order signals from a user.

In the present disclosure, the washing water spray nozzle module is disposed in an area of inner surfaces of the washing chamber and sprays washing water, which is supplied from a water supply tube, into the washing chamber, whereby it is possible to rinse out dishes in the washing chamber by spraying washing water through the washing water spray nozzle module. Further, when washing water is supplied into the washing chamber by the washing water spray nozzle module, it is possible to generate steam using the washing water in the washing chamber or it is possible to generate high-temperature washing water by heating the washing water and then perform ultrasonic washing by applying ultrasonic vibration. The washing water spray nozzle module is not limited to a specific position on the inner surfaces of the washing chamber, but may be disposed on the top of the inner surfaces of the washing chamber to uniformly rinse out all the dishes in the washing chamber and to prevent contamination of the washing water spray nozzle due to contaminants in the washing water by preventing the washing water spray nozzle module from being submerged in the washing water even if the level of the washing water in the washing chamber is high.

The structure of the washing water spray nozzle module can be selected from various spray nozzle structures well known in the art and is not specifically limited.

In the present disclosure, the steam generation module is disposed in the washing chamber and supplies steam into the washing chamber using the washing water that is supplied from the washing water spray nozzle module. The position of the steam generation module is not specifically limited, but the steam generation module may be disposed on the bottom of the washing chamber to be able to quickly generate and supply steam even if a small amount of washing water is supplied in the washing chamber.

In the present disclosure, the induction module is disposed on an outer surface of the washing chamber and heats the washing water supplied in the washing chamber. When the induction module is operated, the walls of the washing chamber are heated, whereby the washing water in the washing chamber is heated. It is possible to generate steam by evaporating the washing water when a small amount of washing water is supplied in the washing chamber and it is possible to boil dishes by generating high-temperature washing water when washing water is supplied at a considerable level in the washing chamber, which contributes to improving washing performance. According to the present disclosure, it is possible to more quickly generate high-temperature steam or washing water in comparison to the existing heating type because it is possible to quickly heat washing water with high thermal efficiency by using the induction module that uses a magnetic field induction principle as a part for heating washing water. Since heat does not transfer to surrounding parts spaced apart from the induction module, there is a technological advantage that it is possible to minimize damage due to heat of the surrounding part, unlike the existing heaters, and it is also possible to reduce energy consumption due to high energy efficiency.

The induction module is disposed on an outer surface of the washing chamber and the position or the number of pieces thereof is not limited. However, the induction module may be disposed on each of three sides except for the surface where an opening is formed of the outer surfaces of the washing chamber to more quickly heat the washing water in the washing chamber.

In the present disclosure, the ultrasonic vibration module is disposed on an outer surface of the washing chamber and applies ultrasonic vibration to the washing water in the washing chamber so that ultrasonic washing is performed. According to the present disclosure, ultrasonic washing is performed by applying ultrasonic vibration to the washing water at a considerable level such that all dishes are submerged in the washing chamber using the ultrasonic vibration module, so it is possible to cleanly wash even the gaps between the dishes in the washing chamber at one time without a dead zone and there is no need for carefully setting up dishes one by one at the angle advantageous for washing when putting the dishes into a rack. When ultrasonic washing by the ultrasonic vibration module is finished, the contaminated washing water remaining the washing chamber is discharged outside through a drain formed in the washing chamber.

The ultrasonic vibration module may be disposed on the bottom of the outer surfaces of the washing chamber in order to further improve the performance of washing dishes by uniformly and effectively transmitting ultrasonic vibration to the entire washing water in the washing chamber.

The household dishwasher according to the present disclosure may further include a UV (Ultraviolet) lamp for sterilization. In more detail, the household dishwasher may include a dish sterilization UV (Ultraviolet) lamp that is disposed in an area of the inner surfaces of the washing chamber and is used to sterilize dishes in the washing chamber after washing is finished and a filter sterilization UV (Ultraviolet) lamp that is disposed close to a filter disposed in the drain formed in the washing chamber and prevents contamination of the filter.

In the present disclosure, the controller is disposed in the body and controls the operational relationships of internal components in response to washing order signals from a user. In the present disclosure, In order to completely remove even residues stuck to dishes for a long time and not easily removed, by maximizing the washing performance, the controller controls washing through a washing process including: (a) filling the washing chamber with 5 to 300 ml of washing water through the washing water spray nozzle module and then steeping dishes by generating high-temperature steam through a steam generation module; (b), after the step (a), filling 50 to 80% of the volume of the washing chamber with washing water through the washing water spray nozzle module and then washing the dishes by boiling the dishes in high-temperature washing water by heating the washing water through the induction module; (c), after the step (c), performing ultrasonic washing by applying ultrasonic vibration to the washing water in the washing chamber through the ultrasonic vibration module; (d), after the step (c), stopping operation of the ultrasonic vibration module, discharging contaminated washing water from the washing chamber, and then rinsing the dishes by spraying or filling washing water in the washing chamber through the washing water supply nozzle module; and (e), after the step (d), filling the washing chamber with 5 to 300 ml of washing water through the washing water spray nozzle module and then sterilizing the dishes by generating high-temperature steam through the steam generation module.

The controller may further control washing through a washing process further including additionally sterilizing the dishes with the dish sterilization UV (Ultraviolet) lamp after the steps (a) to (e) to more completely sterilize the dishes when the household dishwasher of the present disclosure is equipped with the dish sterilization UV (Ultraviolet) lamp.

Meanwhile, the household dishwasher according to the present disclosure may further include a water tank having a structure that is detachably attached to the body, and supplying washing water into the washing chamber. According to the present disclosure, since the water tank is further provided, it is possible to more freely supply washing water, as compared with the direct supply type household dishwasher of the related art, whereby there is an advantage that it is possible to reduce the limitation of installation place. Obviously, the household dishwasher of the present disclosure may be selectively implemented in the direct supply type like the existing household dishwasher.

According to the household dishwasher of the present disclosure, it is possible to improve washing performance because it is possible to uniformly wash all dishes without a washing dead zone, as compared with the existing household dishwasher using the spray type that sprays high-pressure washing water, so it is possible to improve washing performance. Further, there is no need for carefully setting up dishes one by one at the angle advantageous for washing when putting the dishes into a rack, so there is an advantage of being able to improve convenience in use.

Hereafter, the preset disclosure is described with reference to the embodiment shown in the figures to help understand the present disclosure. The embodiment shown in the figure is just an example for describing the present disclosure and does not limit the range of the present disclosure.

FIG. 1 is a perspective view of a household dishwasher according to an embodiment of the present disclosure, FIG. 2 is a perspective view of a household dishwasher according to an embodiment of the present disclosure with a door open, FIG. 3 is a cross-sectional view showing the internal structure of the household dishwasher according to an embodiment of the present disclosure, FIG. 4 is a view showing an example of a water tank that can be detachably attached to a main body of the household dishwasher according to an embodiment of the present disclosure, and FIG. 5 is a diagram showing a washing process that is controlled by a controller of the household dishwasher according to an embodiment of the present disclosure.

Referring to FIGS. 1 and 2, a household dishwasher according to an embodiment of the present disclosure includes a body 100 having a washing chamber 110 therein, and a door 200 disposed on the body 100 and opening/closing the opening of the washing chamber 110 Dishes to be washed are supposed to be put inside a rack 300 and inserted into the washing chamber 110.

Referring to FIG. 3, the dishwasher according to an embodiment of the present disclosure includes: a washing water spray nozzle module 120 disposed at the center of the top of the inner surfaces of the washing chamber 110 and spraying washing water, which is supplied from a water supply tube, into the washing chamber 110; an induction module 130 disposed on each of three sides except for the surface having the opening of the outer surfaces of the washing chamber 110, and heating washing water supplied in the washing chamber 110; an ultrasonic vibration module 140 disposed on the bottom of the outer surfaces of the washing chamber 110 and applies ultrasonic vibration to the washing water in the washing chamber 110 so that ultrasonic washing is performed; a steam generation module 160 disposed in the lower part of the washing chamber; and a drainage part 150 connected to the lower part of the washing chamber.

Referring to FIG. 4, since a water tank 400 keeping washing water is detachably attached to a side of the body 100 in the household dishwasher according to an embodiment of the present disclosure, it is possible to supply washing water required for washing without a restriction of place.

Referring to FIG. 5, the controller of the household dishwasher according to an embodiment of the present disclosure control washing through a washing process including: (a) filling the washing chamber with 5 to 300 ml of washing water through the washing water spray nozzle module and then steeping dishes by generating high-temperature steam through the steam generation module (S10); (b), after the step (a), further filling 50 to 80% of the volume of the washing chamber with washing water through the washing water spray nozzle module and then boiling the dishes in high-temperature washing water by heating the washing water through the induction module (S20); (c), after the step (c), performing ultrasonic washing by applying ultrasonic vibration to the washing water in the washing chamber through the ultrasonic vibration module (S30); (d), after the step (c), stopping operation of the ultrasonic vibration module, discharging contaminated washing water from the washing chamber, and then rinsing the dishes by spraying washing water into the washing chamber through the washing water supply nozzle module (S40); and (e), after the step (d), filling the washing chamber with 5 to 300 ml of washing water through the washing water spray nozzle module and then sterilizing the dishes by generating high-temperature steam through the steam generation module (S50). Accordingly, it is possible to completely remove even the residues stuck to the dishes for a long time and not easily removed, by maximizing the washing performance.

As described above, those skilled in the art may understand that the present disclosure can be achieved in other detailed ways without a change of the spirit or the necessary features of the present disclosure. The scope of the present disclosure is defined by the following claims rather than the above detailed description, and all of changes and modifications obtained from the meaning and range of claims and equivalent concepts should be construed as being included in the scope of the present disclosure.

What is claimed is:

1. A household dishwasher, comprising:

a body having a washing chamber therein, wherein the washing chamber comprises an interior volume in which dishes can be washed;

a door disposed on the body;

a washing water spray nozzle for spraying washing water, which is supplied from a water supply tube, into the washing chamber;

a steam generator disposed in the washing chamber for supplying steam into the washing chamber using washing water supplied from the washing water spray nozzle module;

an induction module for heating washing water supplied into the washing chamber, wherein the induction module is disposed on multiple sides of the washing chamber;

an ultrasonic vibration module disposed on a surface of the washing chamber for applying ultrasonic vibration to washing water in the washing chamber to perform ultrasonic washing; and a controller disposed in the body for controlling a washing process of the household dishwasher in response to washing order signals from a user, wherein the controller is configured to cause the dishwasher to execute the following dishwashing method:

(a) fill the washing chamber with 5 to 300 ml of washing water through the washing water spray nozzle module and then steeping the dishes by generating steam via the steam generator;

(b) after the step (a), fill 50 to 80% of the interior volume of the washing chamber with washing water through the washing water spray nozzle module and then washing the dishes by boiling the washing water that was used to fill 50 to 80% of the interior volume of the washing chamber, wherein the boiling is performed via the induction module;

(c) after the step (b), perform ultrasonic washing by applying ultrasonic vibration to washing water in the washing chamber through the ultrasonic vibration module;

(d) after the step (c), stop operation of the ultrasonic vibration module, discharge contaminated washing water from the washing chamber, and then rinse the dishes by spraying or filling washing water in the washing chamber through the washing water supply nozzle module; and (e) after the step (d), fill the washing chamber with 5 to 300 ml of washing water through the washing water spray nozzle module and then sterilize the dishes by generating steam through the steam generator.

2. The household dishwasher of claim 1, wherein the washing water spray nozzle module is disposed at a top of the washing chamber.

3. The household dishwasher of claim 1, wherein the induction module is disposed on each of three sides opening of outer surfaces of the washing chamber and the steam generator is disposed on a bottom of the washing chamber.

4. The household dishwasher of claim 1, wherein the ultrasonic vibration module is disposed on a bottom of outer surfaces of the washing chamber.

5. The household dishwasher of claim 1, further comprising:

a dish sterilization ultraviolet (UV) lamp used to sterilize dishes in the washing chamber after washing is finished; and a filter sterilization ultraviolet (UV) lamp disposed in a drain formed in the washing chamber, wherein the filter sterilization ultraviolet (UV) lamp prevents contamination of a filter.

6. The household dishwasher of claim 1, further comprising a water tank having a structure detachably attached to the body and supplying washing water into the washing chamber.

7. A method of operating a household dishwasher including a body having a washing chamber that comprises an interior volume in which dishes can be washed, a door disposed on the body, a washing water spray nozzle module for spraying washing water, which is supplied from a water supply tube, into the washing chamber, a steam generator disposed in the washing chamber for supplying steam into the washing chamber using washing water supplied from the washing water spray nozzle module, an induction module disposed on multiple sides of the washing chamber and configured to heat washing water supplied into the washing chamber, an ultrasonic vibration module disposed on a surface of the washing chamber for applying ultrasonic vibration to washing water in the washing chamber to perform ultrasonic washing, and a controller disposed in the body for controlling a washing process of the household dishwasher in response to washing order signals from a user, the method comprising the steps of:

(a) filling the washing chamber with 5 to 300 ml of washing water through the washing water spray nozzle module and then steeping the dishes by generating steam via the steam generator;

(b) after the step (a), filling 50 to 80% of the interior volume of the washing chamber with washing water through the washing water spray nozzle module and then washing the dishes by boiling the washing water that was used to fill 50 to 80% of the interior volume of the washing chamber, wherein the boiling is performed via the induction module;

(c) after the step (b), performing ultrasonic washing by applying ultrasonic vibration to washing water in the washing chamber through the ultrasonic vibration module;

(d) after the step (c), stopping operation of the ultrasonic vibration module, discharging contaminated washing water from the washing chamber, and then rinsing the dishes by spraying or filling washing water in the washing chamber through the washing water supply nozzle module; and (e) after the step (d), filing the washing chamber with 5 to 300 ml of washing water through the washing water spray nozzle module and then sterilizing then dishes by generating steam through the steam generator.

* * * * *